United States Patent [19]

Hoshi

[11] 3,983,851

[45] Oct. 5, 1976

[54] ELECTRONIC FUEL INJECTION APPARATUS

[75] Inventor: Yoshikazu Hoshi, Hitachi, Japan

[73] Assignee: Hitachi, Ltd., Japan

[22] Filed: Mar. 14, 1975

[21] Appl. No.: 558,466

[30] Foreign Application Priority Data

Mar. 18, 1974 Japan ..... 49-29971

[52] U.S. Cl. ..... 123/32 EA; 235/151.2; 123/97 B

[51] Int. Cl.[2] ..... F02B 3/00

[58] Field of Search ..... 123/32 EA; 235/151.2, 235/151.32

[56] References Cited

UNITED STATES PATENTS

| | | | |
|---|---|---|---|
| 3,858,561 | 1/1975 | Aono | 123/32 EA |
| 3,898,962 | 8/1975 | Honig | 123/32 EA |
| 3,906,205 | 9/1975 | Yoshida | 123/32 EA |
| 3,908,614 | 9/1975 | Ironside | 123/32 EA |
| 3,909,601 | 9/1975 | Yamawaki | 123/32 EA |
| 3,911,872 | 10/1975 | Hughes | 123/32 EA |

*Primary Examiner*—Charles J. Myhre
*Assistant Examiner*—Ronald B. Cox
*Attorney, Agent, or Firm*—Craig & Antonelli

[57] ABSTRACT

A fuel injector for injecting fuel by reading the stored information on the predetermined amount of fuel in accordance with the throttle opening and engine revolutions, is provided with an acceleration detector and an acceleration corrector adapted for purification of exhaust gas and fuel injection in conformity with the engine operating conditions.

3 Claims, 5 Drawing Figures

ELECTRONIC FUEL INJECTION APPARATUS

The present invention relates to an electronic fuel injection apparatus, or more in particular to an electronic fuel injection control apparatus having an acceleration correcting apparatus suitable for controlling the amount of injected fuel in accordance with the throttle opening and engine revolutions.

What is most important in an electronic fuel injecting apparatus for electronically supplying fuel of the amount required by the engine is how to detect or determine the required amount of fuel accurately. There is a conventional type of electronic fuel injection apparatus in which the fuel amount is determined by the throttle opening and engine revolutions. In this type of electronic fuel injection apparatus, the relation between the amount of fuel injection and such parameters as the throttle opening or engine revolutions is so complicated as to require a digital control and a digital memory for storing the amount of fuel to be injected.

This type of apparatus has the disadvantage that the amount of fuel injection determined by the throttle opening, one of the main parameters, represents the amount of fuel injection under normal conditions, resulting in a shortage of fuel under accelerating conditions.

Further, since a vehicle is accelerated after detecting the throttle opening, the increased amount of air due to the opened throttle offsets the increased amount of fuel, thus only leading to a shortage of fuel under accelerating conditions. In other words, when the throttle opening is being enlarged sharply for the purpose of acceleration, the air is accordingly increased in amount only at a progressively higher rate than the fuel injection, thus making it impossible to inject sufficient fuel.

An object of the present invention is to provide, in an electronic fuel injection apparatus for control of the fuel supply in accordance with the throttle valve opening and engine revolutions, a low-cost acceleration correcting apparatus for attaining the most suitable density of a mixture gas during the vehicle acceleration.

According to the present invention, there is provided; in an electronic fuel injection control apparatus comprising throttle valve opening detector means for detecting the throttle valve opening and producing a digital signal representing the throttle valve opening, revolutions detector means for detecting engine revolutions and producing a digital signal representing the engine revolutions, a memory for storing the information on the predetermined amount of fuel injection in accordance with the throttle valve opening and engine revolutions, the throttle valve opening detector means and the revolutions detector means producing outputs for determining a read address of the memory and producing information stored in the memory, a valve opening time signal generator circuit for producing in response to an output from the memory a signal representing the time during which the fuel injection valve is opened, a fuel injection valve, and a valve control device for actuating the injection valve in response to an output from the valve opening time signal generator circuit; the improvement further comprising means for detecting the engine acceleration in response to the rotation of the throttle valve, and means for producing a correction signal for fuel addition in response to an output from the acceleration detector means, thereby additionally correcting the amount of fuel at the time of engine acceleration.

The apparatus according to the present invention is provided with means for detecting engine acceleration, whereby fuel is additionally supplied at the time of acceleration. Therefore, the value read out of the memory in accordance with the engine parameters is limited to the normal vehicle conditions, thereby simplifying the memory on the one hand and improving the accuracy with which the fuel is controlled in amount.

The above and other objects, features and advantages will be made apparent by the detailed description taken in conjunction with the accompanying drawings, in which.

Figure 1:
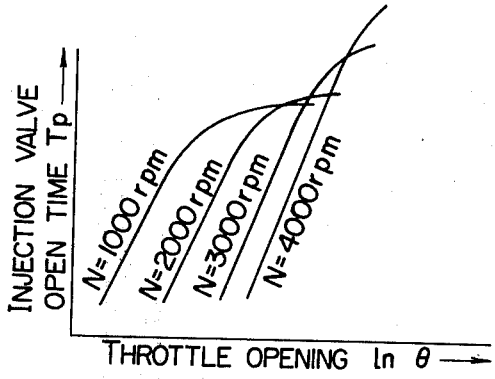
FIG. 1 is a diagram showing the operating characteristics of an engine.

Referring to FIG. 1 showing the characteristics of an ordinary engine run with a circular butterfly valve, the ordinate represents the time Tp during which an electromagnetic valve is opened for injecting fuel, and the abscissa the natural logarithm of throttle opening $\theta$. Thus the drawing under consideration shows the relation between the throttle opening $\theta$ and the valve open time Tp with the engine revolutions N as a parameter. As will be seen from the drawing, the valve open time Tp is proportional to the logarithm of the throttle opening $\theta$ in the greater part of the curve representing the same. It will also be obvious that during the acceleration when the characteristic curve is not linear and the throttle opening is large, the pulse width substantially required is small in change, and therefore the correction thereof is not required. In other words, at a certain level of throttle opening $\theta$ or higher, the amount of air inflow changes with the throttle opening much less than at the other levels thereof. As a result, the valve open time may change less with the throttle opening, in view of the fact that there is a certain relation between the amount of air inflow and the amount of injected fuel. When the throttle opening is large, the amount of air is not increased very much by further opening the throttle for acceleration, and therefore there is not so much need for correction for fuel addition at the time of acceleration.

It was already explained that in FIG. 1, the injection, namely, the valve open time is substantially proportional to the natural logarithm of the throttle opening. For this reason, it will be understood that it is desirable to determine the amount of fuel addition at the time of acceleration on the basis of the changes in throttle valve opening in the form of changes in logarithmic function.

Figure 2:
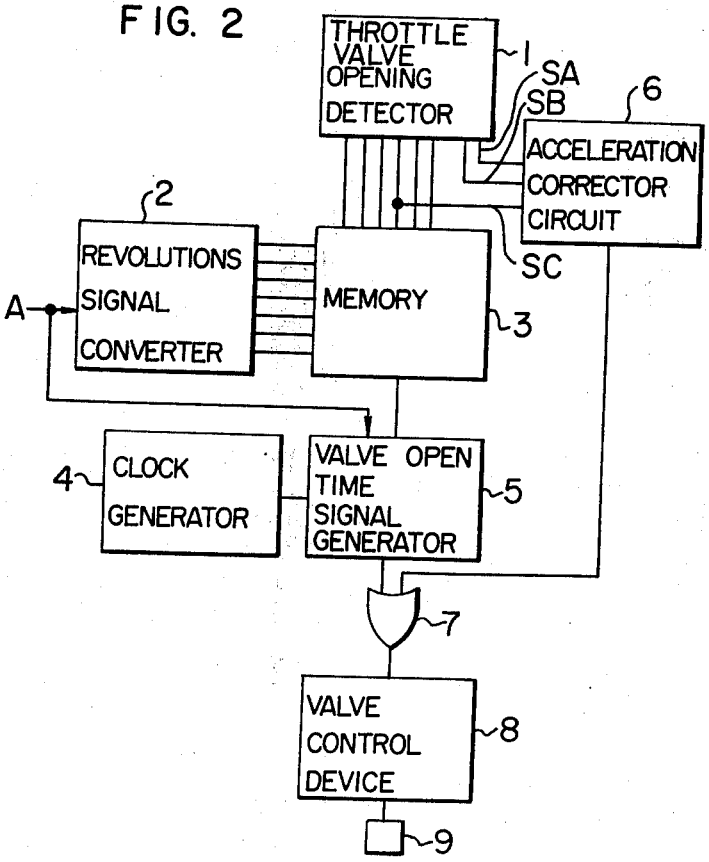
FIG. 2 is a block diagram showing an embodiment of the present invention.

An embodiment of the invention is shown in FIG. 2. A throttle valve opening detector 1 is for converting the throttle opening into a digital value. In addition to this information, the throttle valve opening detector 1 produces a couple of phase discriminating signals SA and SB. The particular circuit for producing such signals will be described more in detail with reference to FIG. 3. A revolutions signal converter 2 is provided for the purpose of converting into an appropriate digital signal a digital signal generated in synchronism with the engine or an analog signal A generated by a tachogenerator or the like. Reference numeral 3 shows a memory of which an information storage location is designated by the throttle opening signal and the revolutions signal, so that the digital amount stored in the particular address is retrieved and applied to a valve open time signal generator 5. The valve open time signal generator 5 receives a signal from the clock generator circuit 4 and produces a signal representing the injection time in synchronism with the revolutions signal A through, say, a counter. The acceleration correction circuit 6 functions to produce a pulse of predetermined width in response to the phase discriminating signals SA and SB of the throttle opening detector 1 in accordance with a change of a bit after several pulses arriving from the detector 1, only when the throttle is open. The output signal from the acceleration correction circuit 6 is applied to the adder 7, together with a signal from the valve open time signal generator circuit 5, with the result that the result of addition of both the inputs is produced from the adder 7. In this embodiment, even if the engine is accelerated with a signal produced from the memory 3, there is no change in the final valve open time for fuel injection.

It is possible to distinguish whether the throttle is fixed in opening or being opened or closed, by the phase discriminating signal SA or SB applied to the acceleration correction device 6. The throttle being opened is detected by the phase discriminating signals, and the signal SC is used to distinguish whether or not the throttle opening is changing at a fixed rate. When the engine is found to be accelerating at a certain level or higher, a signal is produced from the acceleration correction device 6. This signal is in the form of a pulse having a time width proportional to the degree of acceleration.

When both the signals from the acceleration correction device 6 and from the valve open time signal generator circuit 6 are overlapped, the amount of fuel is not increased since the same output as the signal from the valve open time signal generator circuit 5 is produced from the OR gate 7.

In the event that a signal is produced from the acceleration correction device 6 in the absence of a signal from the valve open time signal generator circuit 5, on the other hand, the OR gate 7 produces a signal in response to such a signal from the acceleration correction device 6 in spite of the absence of a signal from the valve open time signal generator circuit 5, so that, in accordance with the output from the OR gate 7, the electromagnetic valve 9 injects fuel for acceleration through the valve control device 8.

In this connection, the throttle valve detector is as disclosed in detail by the U.S. patent application Ser. No. 415,327 dated Nov. 13, 1973, now abandoned. Also, as to the circuit for reading from the memory 3 a required amount of fuel on the basis of the parameters including the throttle opening and the engine revolutions, it is described in detail in the U.S. patent application Ser. No. 334,401 of Feb. 21, 1973 and now U.S. Pat. No. 3,846,625.

Figure 3:
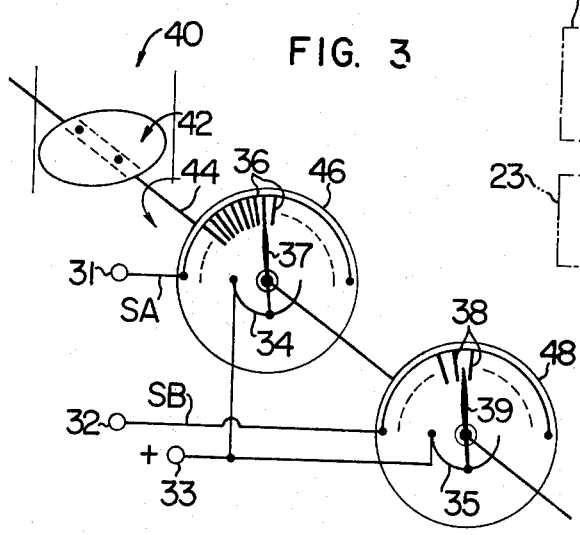
FIG. 3 is a diagram for explaining in detail a phase discriminating signal generator.

A device for generating the phase discriminating signals SA and SB from the throttle opening detector 1 is shown in FIG. 3. A throttle 42 provided on the intake manifold 40 is interlocked with the switches 46 and 48 through a rod 44. The switches 46 and 48 have fixed contact pairs 34, 36; and 35, 38 respectively, which are adapted to be short-circuited with each other by movable contacts 37 and 39 rotatable on the rod 44. The movable contacts 37 and 39 have such a phase relationship that, when the contact 37 causes the short-circuiting between the fixed contacts 34 and 36, the fixed contacts 35 and 38 are not necessarily short-circuited with each other by the movable contact 39, that is to say, the fixed contacts 35 and 38 may be cut off from each other as shown in the drawing. Further, both the movable contacts 37 and 39 are closed with the respective fixed contacts. In the last-mentioned case, a high level voltage applied to the terminal 33 is produced at the terminals 31 and 32.

Figure 4:
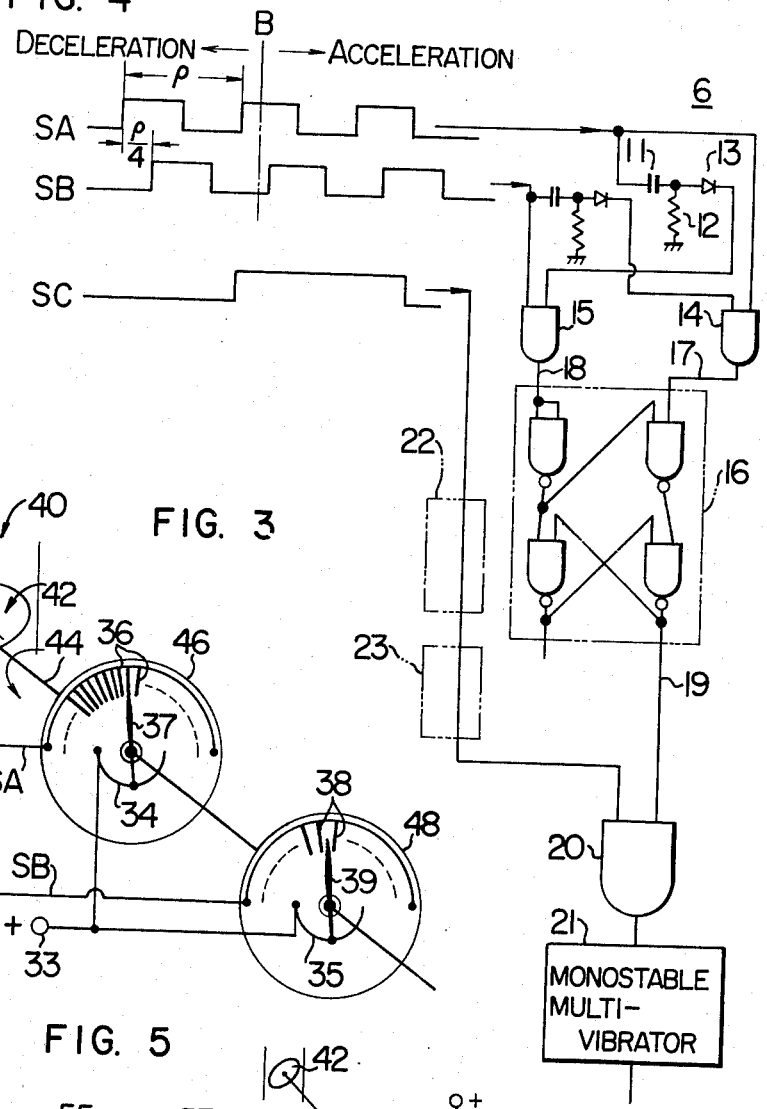
FIG. 4 is a diagram for explaining the acceleration corrector circuit shown in FIG. 2.

Reference is had to the diagram of FIG. 4 for explaining the function of the acceleration correction circuit 6 more in detail.

As shown, the two phase discriminating signals SA and SB are such that, assuming that the throttl is operated to switch the movable contact 37 at time intervals P, the other movable contact is suitably rotated with the phase difference of P/4.

When the detection point is B, it is assumed that an acceleration is involved if it moves rightward, that a deceleration is involved when it moves leftward, and that the output of the phase discriminating signal is at high level at upwardly protruded portions of the waveform and at low level at downwardly protruded portions. Then, an accelerating condition is detected by the rise of the phase discriminating signal SB from low to high level when the other phase discriminating signal SA is at high level. The detection of a decelerating condition, on the other hand, is accomplished when the phase discriminating signal SA rises from low to high level while the other signal SB is at high level.

The signals SA and SB are applied directly to the AND gates 14 and 15 respectively. Only one of the signals differentiated by a differential circuit comprising a differentiating capacitor 11 and a differentiating resistor 12, which rises from low to high level, is applied to the AND gate 15 to which the other discriminating signal is applied through a diode 13. In this way, the output of the AND gate 14 represents an acceleration signal, whereas that of the AND gate 15 indicates a deceleration signal.

Reference numeral 16 shows a reset-first flip-flop. When a signal of high level is applied to the set terminal 17 thereof, a signal of high level is produced at the output terminal 19. This state remains unchanged even after the input to the set terminal 17 disappears, and the output at the reset terminal 18 becomes high in level when the output at the output terminal 19 changes to low level.

As long as signals of high level are applied to both the set terminal 17 and reset terminal 18, the output terminal 19 always produces a low level signal.

In other words, the apparatus according to the invention operates in such a manner that once an accelerating condition is detected, the output at the terminal 19 of the flip-flop 16 becomes high in level and remains at that level till the next decelerating condition presents itself. This output is applied to an AND gate 20, to which is also applied a signal following several bits produced from the throttle detector. This signal SC varies with variations in throttle. The output of the AND gate 20 is applied to the next monostable multivibrator 21, thereby producing a pulse with a fixed width in accordance with changes in the opening of the throttle.

The input circuit of the monostable multivibrator 21 has a capacitor so as to be energized at the very instant the input of the AND gate 20 changes from low to high level. In order to assure accurate energization of the monostable multivibrator 21 in response to the signals representing variations in throttle opening, a differentiating circuit 22 and a waveform shaping circuit 23 are preferably inserted as shown by rectangles of dotted lines. Each time the signal SC changes from high to low level or from low to high level, the differentiating circuit 22 produces a pulse, which, after being shaped by the waveform shaping circuit 23, is applied to the AND gate 20, thus making it possible to accurately grasp the changes in signal SC.

However, the operation of detection of decelerating and accelerating conditions as described in FIG. 4 is very rough. In other words, an accelerating condition is detected only at a high level of signal SA, and under the engine accelerating condition with the signal SA at low level, the detection thereof is not possible until the throttle opening reaches a point where the signal SA changes to high level. This shortcoming may be obviated by providing small angles corresponding to variation in signal SA and SB, namely, small intervals between fixed contacts 36 or 38 in FIG. 3, as against the throttle angle corresponding to variations in signal SC. Alternatively, a signal representing a fall of the signal SB at a low level of signal SA may be applied to the set terminal 17 of FIG. 4.

In view of the fact that as shown in FIG. 1 the injection valve open time Tp is proportional to the natural logarithm of the throttle opening, the throttle opening detector 1 preferably detects the throttle opening as a logarithmic function and digitizes it.

Figure 5:
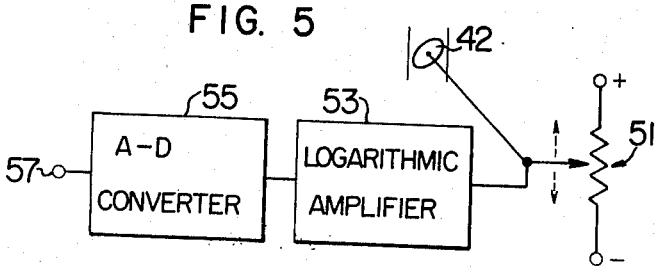
FIG. 5 is a diagram for explaining the throttle opening detector shown in FIG. 2.

Such a digital circuit is shown in FIG. 5. The variable resistor 51 is operatively interlocked with the throttle 42 thereby to produce a voltage representative of a throttle angle. This output signal is applied to the logarithmic amplifier 53, thereby producing an output signal proportional to the logarithm of that input signal voltage, which output signal is converted into a digital signal by an A-D converter. It is generally known that the logarithmic amplifier 53 is obtained, for example, by connecting the emitter and collector of a transistor with its base grounded, to the input and output terminals of an operational amplifier respectively.

It will be understood from the foregoing description that according to the present invention a proper amount of additional fuel is supplied at the time of acceleration, and therefore only the amount of fuel required for normal run of the engine may be stored in the memory, thus simplifying the memory construction. Further, the amount of fuel suitable for purification of exhaust gas may be stored in the memory, so that fuel is added only when the engine is short of fuel, thus contributing to improve purification of exhaust gas.

It will thus be seen that the objects set forth above, among those made apparent from the preceding description, are efficiently attained, and since certain changes may be made in the above construction without departing from the spirit and scope of the invention, it is intended that all matters contained in the above description or shown in the accompanying drawings shall be interpreted as illustrative and not in a limiting sense.

What I claim is:

1. In an electronic fuel injection apparatus comprising throttle valve opening detector means for detecting the throttle valve opening and producing a digital signal representing the throttle valve opening, revolutions detector means for detecting engine revolutions and producing a digital signal representing the engine revolutions, a memory for storing the amount of fuel injection in accordance with the throttle valve opening and engine revolutions, said throttle valve opening detector means and said revolutions detector means producing outputs for determining a read address of said memory and producing information stored in said memory, a valve opening time signal generator circuit for producing in response to an output from said memory a signal representing the time during which the fuel injection valve is opened, a fuel injection valve, and a valve control device for actuating said fuel injection valve in response to an output from said valve opening time signal generator circuit; the improvement further comprising means for detecting the engine acceleration in response to the rotation of said throttle valve, said acceleration detector means comprising a phase discriminating signal generator circuit for generating a couple of phase discriminating signals of different phases in accordance with variations in the throttle opening and a gate for detecting an engine accelerating condition in response to said phase discriminating signals, and means for producing a correction signal for fuel addition in response to an output from said acceleration detector means, thereby additionally correcting the amount of fuel at the time of engine acceleration.

2. An electronic fuel injection apparatus according to claim 1, in which said gate for detecting an accelerating condition includes a differentiating circuit, means for applying one of said phase discriminating signals to said gate through said differentiating circuit, and means for applying the other of said phase discriminating signals to said gate.

3. An electronic fuel injection apparatus according to claim 2, further comprising a monostable circuit for producing a correction signal, a second gate for applying a signal to said monostable circuit, first signal transmitter means for applying to said second gate for the output of said first gate detecting an accelerating condition, and second signal transmitter means for applying an appropriate digital bit signal produced from said throttle valve opening detector means to said second gate.

* * * * *